US005199138A

United States Patent [19]

Morita

[11] Patent Number: 5,199,138

[45] Date of Patent: Apr. 6, 1993

[54] MAGNETIC FASTENER

[75] Inventor: Tamao Morita, Tokyo, Japan

[73] Assignee: Tarmo Co., Ltd., Tokyo, Japan

[21] Appl. No.: 899,979

[22] Filed: Jun. 17, 1992

[30] Foreign Application Priority Data

Jun. 17, 1991 [JP] Japan ..... 3-170396

[51] Int. Cl.[5] ..... A44B 21/00

[52] U.S. Cl. ..... 24/303; 292/251.5

[58] Field of Search ..... 24/303, 94, 49 M, 688; 292/251.5; 335/285; 63/14.1, 29.2

[56] References Cited

U.S. PATENT DOCUMENTS 3,127,653 4/1964 Budreck ..... 24/303
4,453,294 6/1984 Morita ..... 24/303
4,505,007 3/1985 Aoki ..... 24/303
4,991,270 2/1991 Aoki ..... 292/251.5
5,042,116 8/1991 Ossiani ..... 24/303

*Primary Examiner*—Victor N. Sakran
*Attorney, Agent, or Firm*—Pennie & Edmonds

[57] ABSTRACT

The present invention relates to a fastener means that utilizes the attraction of a permanent magnet.

The present invention is an improvement on the female member having a slide plate which is to be attracted by the permanent magnet of the male member. More particularly, the improvement relates to a first and a second plates between which the slide plate is to be slidably inserted. By providing catches and indented portions which receive the catches in the first and the second plates and by welding the first and the second plates firmly while the catches are fitted in the indented portions.

14 Claims, 8 Drawing Sheets

MAGNETIC FASTENER

OUTLINE OF THE INVENTION

The present invention relates to a fastener means for various types of bags such as shoulder and rucksacks, and for various types of boxes and belts.. It also relates to a fastener means for anchoring an open door to a wall.

More particularly, the present invention relates to an improvement of a fastener means which comprises a male member having a permanent magnet, a female member having a ferromagnetic slide plate which engages with said male member by magnetic attraction.

Still more particularly, the fastener means according to the present invention is characterized in that there is provided an interval to allow smooth and secure movement of said slide plate of the female member, and that when a projection of the male member is inserted in the female member, said slide member is smoothly and securely attracted toward the projection. The construction of the present invention fastener means is such that the female member having said interval for allowing smooth and secure sliding of the slide plate can be easily formed.

A fastener means utilizing the attraction force of a permanent magnet is advantageous in that it is easy to use as the female member is easily attracted to and detached from the male member, and can be made relatively simple in structure. The magnetic fastener means is therefore widely used for various bags such as handbags, rucksacks, shoulder bags and brief cases, for various types of boxes and belts and other similar fastening purposes.

However, a fastener means of this type is defective in that when a force or an impact stronger than the attraction force of the permanent magnet is exerted on the male and female members, they tend to become easily disengaged.

To overcome the defect, there has been proposed a fastener means comprising a ferromagnetic female member which has a hole for receiving the projection of a male member, the male member having a projection whose head is larger in diameter than the shaft and a permanent magnet at the base of said projection.

With this type of fastener means, the female member is attracted by the permanent magnet of the male member when the projection of the male member is inserted in the hole of the female member to effect tentative engagement between the two members. By twisting the projection, the head of the projection that extends laterally from the shaft is disposed on a plate portion near the periphery of the hole in the female member to firmly lock the two members.

Although firm engagement of the male and female members is achieved in this type of fastener means, it is rather troublesome to twist the projection of the male member every time it is inserted in the female member, and more particularly, to pull the two members apart in addition to twisting the projection of the male member for detaching the two members.

In view of the foregoing, various improvements have been proposed to provide a fastener means which is easy in manipulation. The fastener means proposed by JP Publication No. Hei 3-14983 is a typical example.

According to the patent, the projection of the male member has a laterally extending head portion which is either made of or provided with a permanent magnet.

The female member has a hole for receiving the projection of the male member, and when the projection of the male member is inserted therein, a ferromagnetic plate slidably incorporated in the female member is attracted to the projection, so that the ferromagnetic plate becomes locked with said laterally extending portion of the projection when a force is exerted to pull the male member out of the female member.

The fastener means of this type is still defective in that component parts of the fastener means are not necessarily easy to assemble, and the appearance of the fastener means is not quite appealing.

OBJECT OF THE INVENTION

The present invention aims at improving the invention of JP Publication No. Hei 3-14983.

The primary object of this invention is to provide a female member of a simplified structure with reduced number of component parts.

Another object of this invention is to enable accurate assembling of the component parts of the female member, so that the slide plate incorporated in the female member can perform its function accurately.

Still another object of this invention is to allow easy manufacture of the female member by welding catches made on one of the component parts thereof with dents made in another component part as they are engaged.

These and other objects of the present invention will become apparent from the following description.

Figure 7:
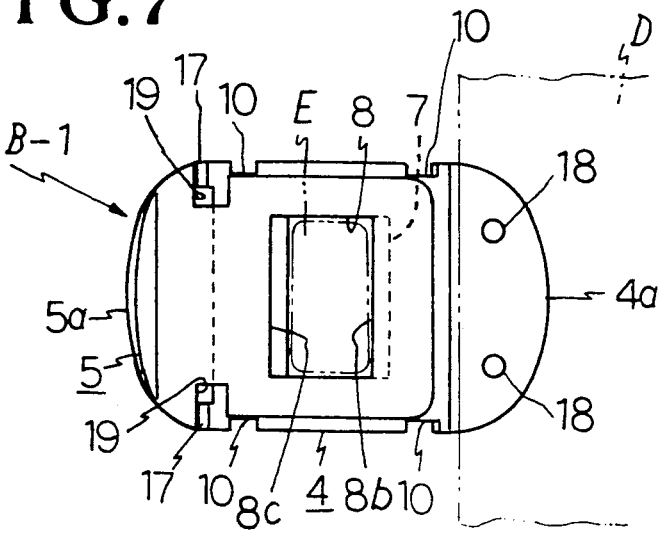
Figure 8:
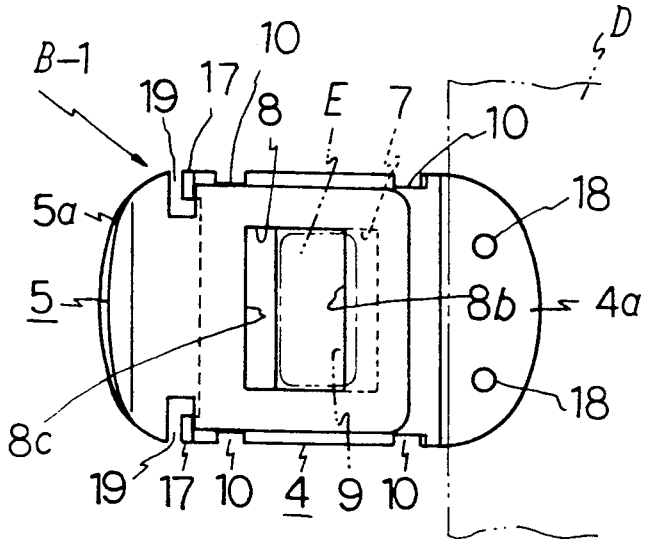

FIGS. 7 and 8 show the movements of a slide plate 5 when the male member A-1 is inserted in the female member B-1 from which is removed the first plate member 3; FIG. 7 showing the projection E of the male member A-1 as it is being inserted, and FIG. 8 the projection E as it is inserted.

Figure 9:
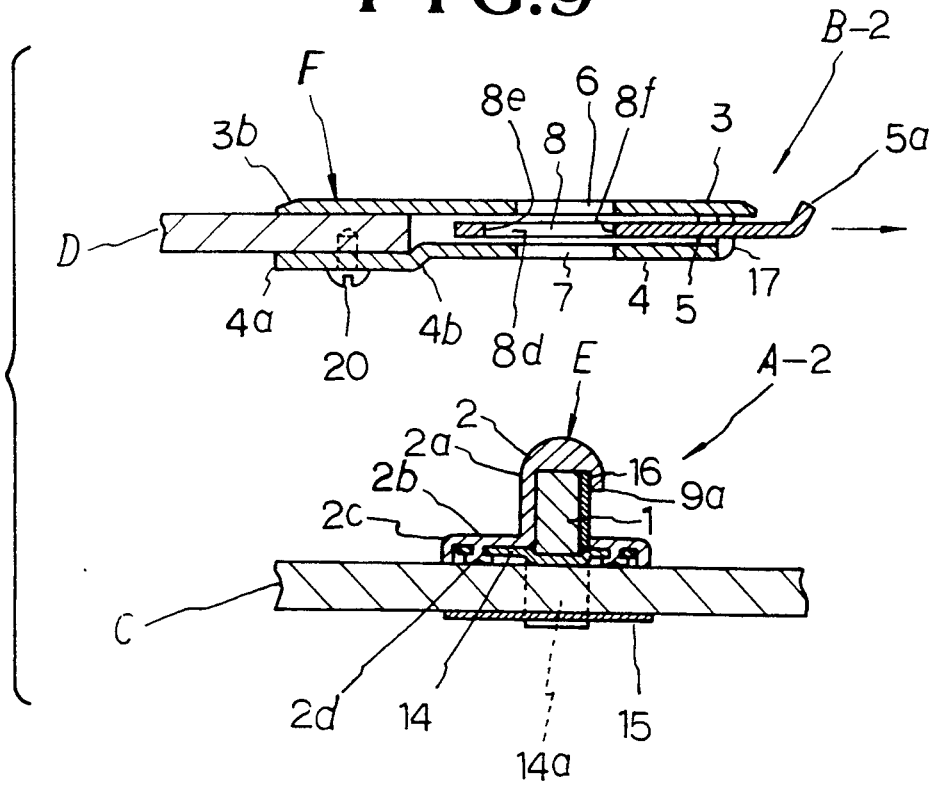

FIG. 9 is a sectional view to show a fastener means according to the second embodiment before the male and female members are engaged.

Figure 10:
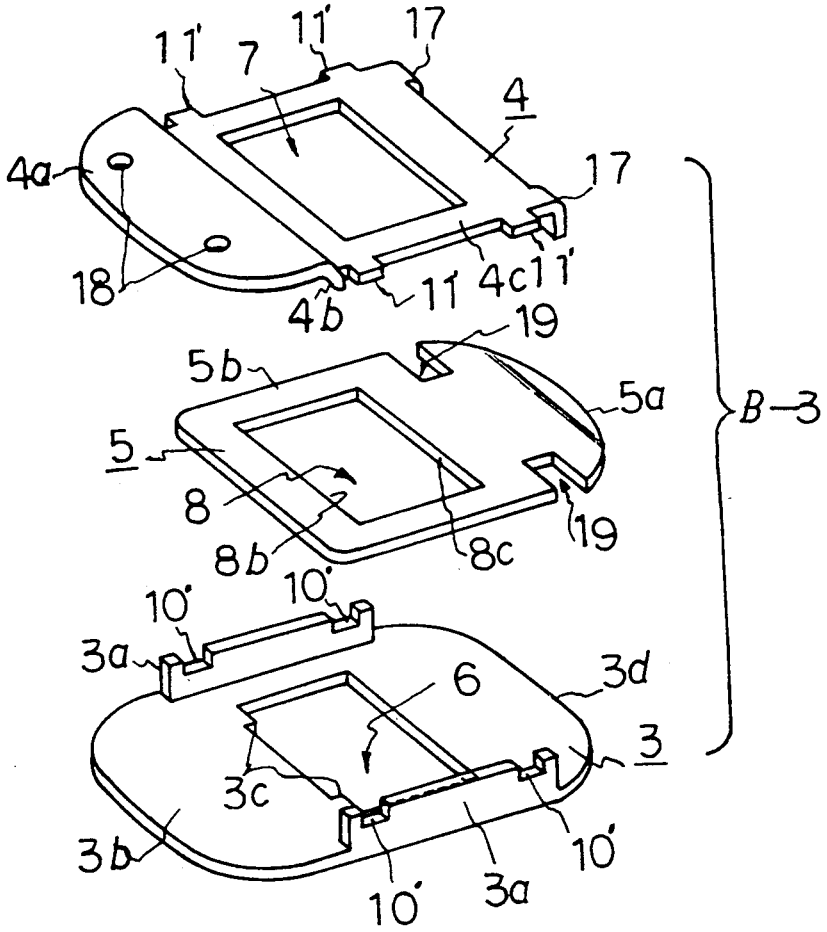
Figure 11:
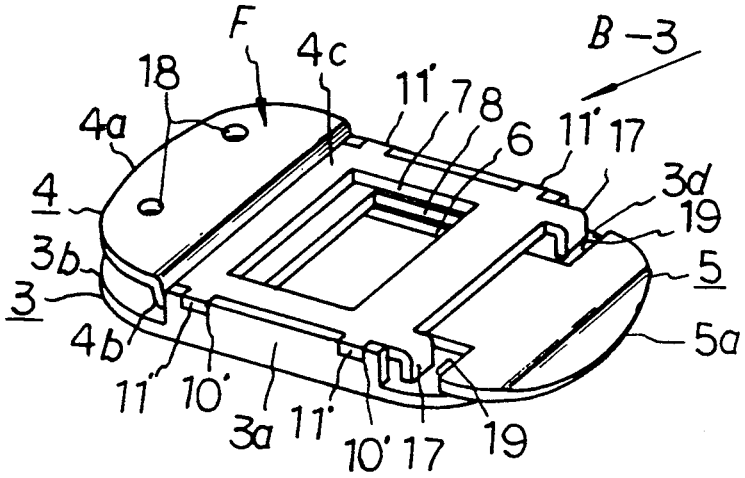

FIGS. 10 and 11 are the views to show a female member B-3 according to the third embodiment; FIG. 10 showing the component parts in an exploded perspective view, and FIG. 11 the female member B-3 in perspective view.

Figure 12:
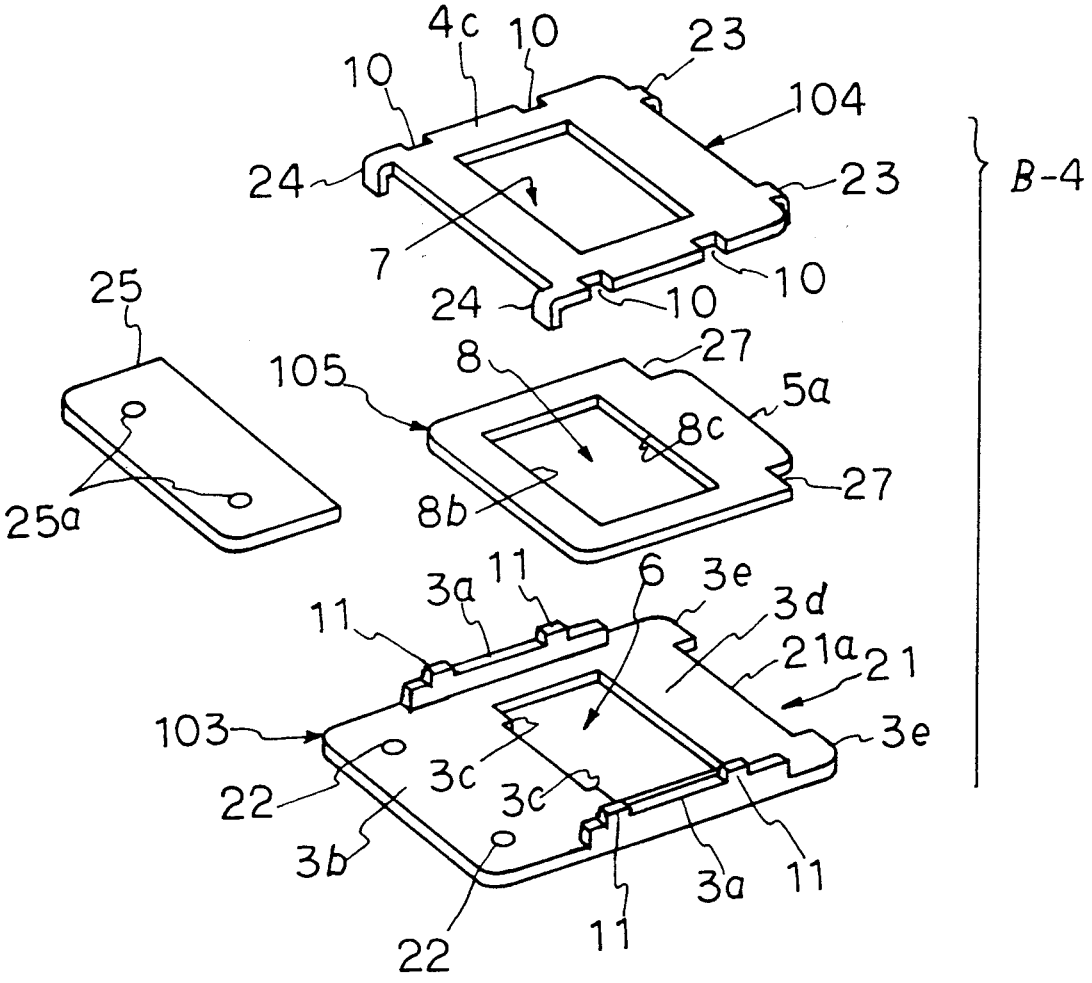
Figure 13:
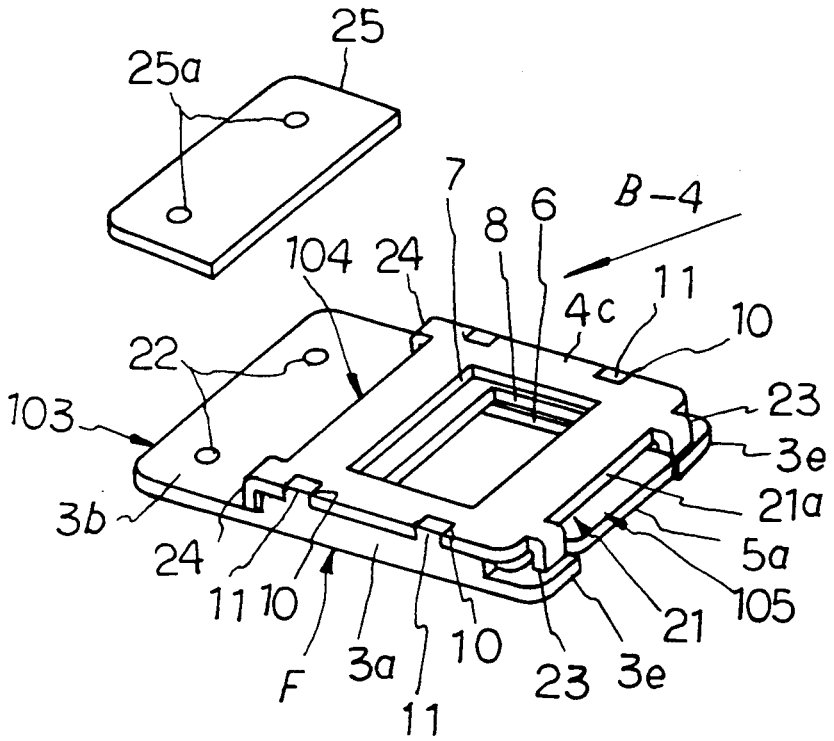
Figure 14:
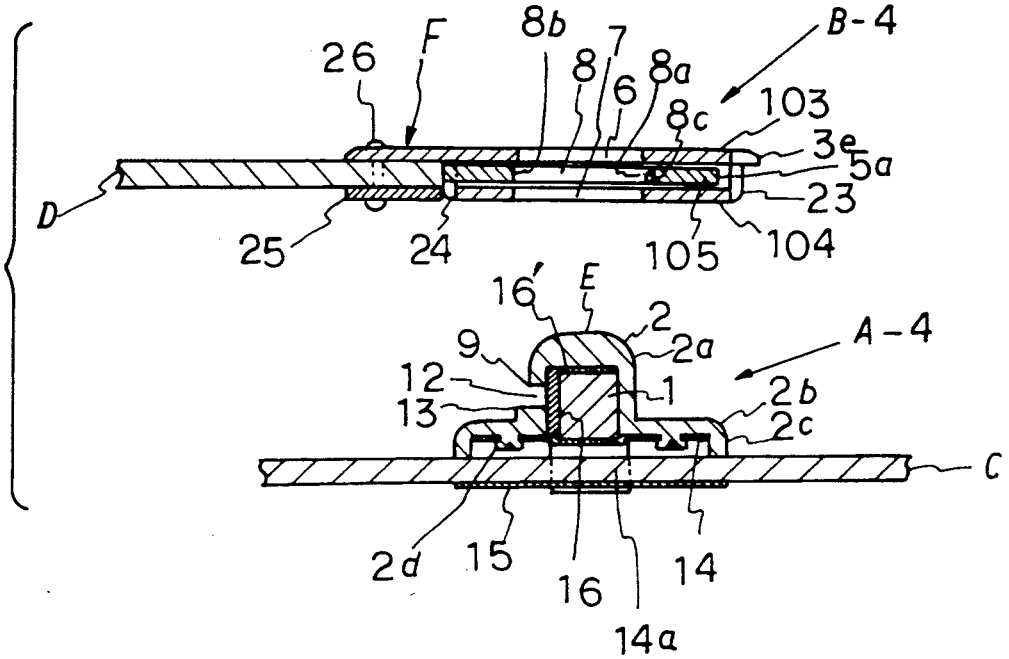
Figure 15:
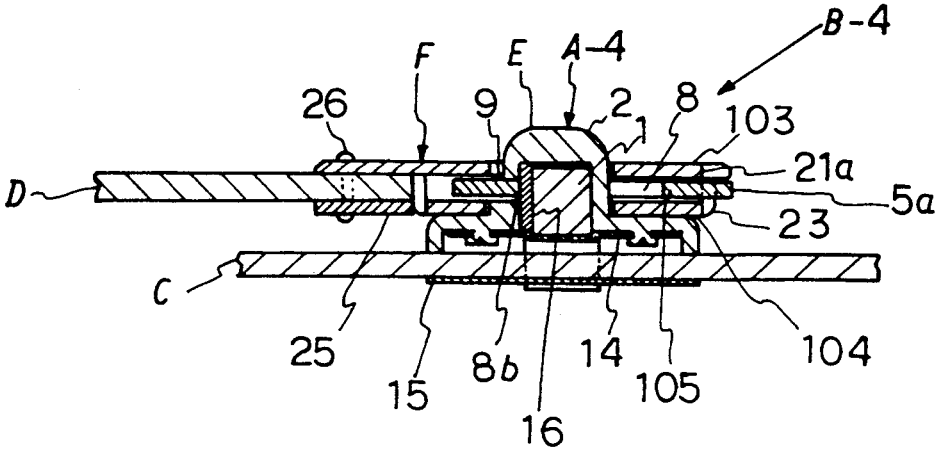

FIGS. 12 through 15 show the female member B-4 according to the fourth embodiment; FIG. 12 is an exploded perspective view to show a female member B-4, FIG. 13 the female member B-4 in perspective, and FIGS. 14 and 15 the engagement of the male and female members according to the fourth embodiment in sectional views.

EMBODIMENTS

The male member A and the female member B will now be described in more detail by way of various embodiments.

The male member A-1 and the female member B-1 according to the first embodiment shown in FIGS. 1 through 8 will now be described.

The male member A-1 has a projection E which includes a shaft 2 made of a non-magnetic material and a permanent magnet 1 incorporated in the shaft 2.

The shaft 2 has an inner cavity which extends from the bottom of the projecting portion 2a toward the head, the projection portion 2a being substantially rectangular in plan view. The vertical section of said head is arc-shaped to allow smooth insertion into the female member B-1.

An engagement dent 12 having a jaw 9 is provided along the length of the projection E.

A stepped portion 13 constituting the engagement dent 12 is provided at the base of the portion 2a. A seat 2b extends laterally and integrally from the periphery of the base of the portion 2a. An edge 2c extends downwardly from the periphery of the seat 2b. A boss 2d is provided at the bottom of the seat 2b surrounded by the edge 2c to act as a fixing means for a leg member 14.

The leg member 14 includes leg strips 14a, 14a that are inserted in the slit of a washer 15 and bent for firm engagement of the fastener means by being inserted in the base material C such as the leather material of a bag to which the fastener means is to be attached. The leg member 14 is so constructed that it fits in a dent formed at the bottom of the seat 2b to shield the cavity in the projection shaft 2. An aperture is formed in the leg member 14, so that said boss 2d will project from the aperture when the leg member 14 is tightly fixed at the bottom of the seat 2b. The boss 2d is pressed against the face of the leg member 14 to allow the leg member 14 and the projection shaft 2 to become engaged.

A permanent magnet 1 and a ferromagnetic plate 16 are fitted in the projection shaft 2 thus assembled. The leg member 14 is also fitted to the seat 2b of the shaft 2. The permanent magnet 1 and the ferromagnetic plate 16 are thus firmly fitted inside the projection shaft 2 to form the male member A-1 having the projection E. The male member A-1 is then attached to the base material C. The leg strips 14a of the member A-1 are inserted in the base material C, and the washer 15 is fitted over the leg strips 14a. The leg strips 14a are bent toward the base material to firmly fix the member A-1 to the base material C.

It is noted that said ferromagnetic plate 16 acts to effectively attract the slide plate 5 to be described below. It is therefore preferable that the plate 16 should be exposed via a window provided in the projection portion 2a of the shaft 2.

Said stepped portion 13 provided at the projecting portion 2a functions to engage the projection E and the female member B-1 firmly.

The projection E of the male member A-1 comprises the projection shaft 2 and the permanent magnet 1. The permanent magnet 1 is made of, for example, a ferrite magnet and is covered by the projection shaft 2. Alternatively, the male member A as a whole except for fixing means such as the leg member 14 can be made of a permanent magnet, such as a plastic magnet.

In this case, the amount of magnetism of the male member A would be greater than that of the male member A-1 according to the above embodiment having the same bulk, and the male member A can be made still smaller.

It is also possible to use a ferromagnetic material to construct the projection portion 2a of the shaft 2 constituting the projection E. This construction prevents leakage of magnetism from the permanent magnet 1 constituting the projection E.

When the ferromagnetic plate 16 is provided on the side of the window in the shaft 2 as mentioned above, the ferromagnetic plate 16 acts to cover the window to shield the permanent magnet 1 inside, as well as to converge the magnetic field of one of the magnetic poles of the magnet 1, enabling the slide plate 5 of the female member B-1 to be firmly and stably attracted.

It is also possible to use the permanent magnet 1 alone without the ferromagnetic plate 16. Instead of providing the window, said cavity for receiving the permanent magnet 1 can be made a blind hole.

A ferromagnetic plate may be disposed at each magnetic pole of the permanent magnet 1. The ferromagnetic plates at the magnetic poles may be extended to reach the side face of the permanent magnet. This prevents leakage of magnetic flux. The magnetic poles of the permanent magnet 1 may be disposed vertically with respect to FIG. 5.

The construction of the engagement dent 12 to be provided on the projection E may be such that the upper face of the slide plate 5 of the female member B-1 would abut against the jaw 9 of the dent 12 when the slide plate 5 is attracted to the surface of the projection E located below the jaw 9. When the slide plate 5 of the female member B-1 is attracted to the jaw 9, the male and female members A and B become firmly engaged.

Although the engagement dent 12 is provided in the projection E so that the side end of the slide plate 5 attracted inside the dent 12 abuts against the jaw 9 located at the upper edge of the dent 12, it is also possible to provide the jaw 9 alone in the projection E and omit the stepped portion 13.

In other words, an engagement strip 9a as shown in FIG. 9 may be protruded so that the upper end face of the slide plate 5a can be engaged with the strip 9a.

Alternatively, the engagement strip 9a may be a flange projecting from the projection E.

Still alternatively, the engagement strip 9a may be formed as a pin or a small projection protruding from the projection E.

Said leg member 14 may be made of a ferromagnetic material to prevent leakage of the magnetic flux from the permanent magnet 1. The leg member 14 may also be made of a non-magnetic material, in which case the leg strips 14a do not act as a passage for the magnetism from the permanent magnet 1 to reach the washer 15 attached to the base material C.

The female member B-1 will now be explained.

The female member B-1 includes a female frame F comprising a first plate 3 and a second plate 4, and a slide plate 5 made of a ferromagnetic material which is to be inserted between said first and the second plates 3 and 4 of the female frame F.

The slide plate 5 to be used here is made of a material that can be effectively attracted by the permanent magnet 1, such as so called ferromagnetic material which has an excellent magnetic permeability.

The first and the second plates 3 and 4 may be made of a material such as metals and plastics suitable for welding that would allow the plates to be firmly connected by various welding methods. They may be either magnetic or non-magnetic.

If the first and the second plates 3 and 4 of the female frame F are made of a non-magnetic material, the projection E of the male member A-1 can be easily inserted in the female member B-1 and the movement of the slide plate 5 can be made smooth and accurate.

If these plates 3 and 4 are made of a ferromagnetic material, magnetic leakage from the fastener means when the male and the female members are engaged can be prevented.

When the second plate 4 is made of a ferromagnetic material, the female frame F can be firmly attracted to the permanent magnet 1 of the male member A-1 regardless of whether the first plate 3 is magnetic or non-magnetic.

The first plate 3 will now be explained.

The first plate 3 includes opposing sides 3*a*, 3*a* formed by bending the plate on both sides, so that said slide plate 5 can be slidably inserted between the two opposing sides.

Catches 11 extend upward from the upper edges of the sides 3*a*. The catches 11 may be provided in any arbitrary number depending on the shape and the size of the female frame F. The width may also be arbitrarily selected.

Typically, the catches 11 may be formed, as shown in the figure, at the same height or slightly shorter than the thickness of the second plate 4 so that the catches 11 are arranged to be conveniently fitted in indented portions 10 to be described.

Further, there is provided an opening 6 in the first plate 3 through which the projection E of the male member A-1 is inserted. There are also included plate portions 3*b* and 3*d* which extend farther beyond the position where the sides 3*a* are located. One of the portions 3*b* is used to fix the fastener means to the base material D of a bag such as leather.

Catches 3*c*, 3*c* are also provided at the periphery of the opening 6 on the side of the portion 3*b*, so as to retain the head of the projection E in place when the projection E is inserted in the opening 6.

The second plate 4 will now be explained.

The second plate 4 includes a portion 4*a* which corresponds to the portion 3*b* of the first plate 3, the portion 4*a* extending beyond a bent portion 4*b*. An indented portion 10 is provided on both sides of the portion 4*c* on sides 3*a* of the first plate 3 to receive each catch 11 of the first plate 3. On the opposite side of the portion 4*a*, there is provided an engagement strip 17 each which is bent downward to reach the face of the plate 3.

The indented portion 10 provided in the second plate 4 preferably has the depth substantially the same as the plate thickness of the side 3*a*, so that the plates 3 and 4 when connected, will have a streamlined appearance.

There are provided through-holes 18 for screws on the plate portion 4*a*, while an opening 7 which communicates with the opening 6 in the first plate 3 is provided in the plate portion 4*c*. The opening 7 has a size that will loosely receive the base of the projection E of the male member A-1.

The slide plate 5 which is inserted between the first and the second plates 3 and 4 will now be explained. The slide plate 5 also has an opening 8 which is wider than the openings 6 and 7 in longitudinal direction. The slide plate 5 further includes a plate portion 5*b* which fits inside the sides 3*a* and 3*a* of the first plate 3, and a slightly curved lip member 5*a* for manipulation which projects slightly outside when the first and the second plates 3 and 4 are connected. On the edges extending between the manipulation lip member 5*a* and the plate portion 5*b* is provided a groove 19 in which said engagement strips 17 of the plate 4 rest respectively.

The slide plate 5 to be inserted in the female frame F is provided on the side of the lip member 5*a* with an opening 8*a* which is wider than the openings 6 and 7 of the first and the second plates 3 and 4 respectively. The slide plate 5 is preferably pressed into the female frame F in such a manner that the periphery 8*b* of the opening 8 on the side opposite the lip member 5*a* will substantially come in alignment with the peripheries of the holes 6 and 7 of the first and the second plates 3 and 4 respectively.

To achieve this positional relation of the slide plate 5 and the female frame F, said engagement strips 17 and the grooves 19 must be provided in advance at respectively appropriate positions.

Assembling of the female member B-1 comprising the above mentioned component parts will now be explained.

The slide plate 5 is first placed in between the sides 3*a*, 3*a* of the first plate 3 at a position such that the manipulation lip member 5*a* will project slightly outside from the portion 3*d*.

The second plate 4 is then placed over and between the sides 3*a*, 3*a*, so that the catches 11 provided on the sides 3*a* will be fitted in the indented portions 10 of the second plate 4. In doing so, care is taken to make the engagement strips 17 of the plate 4 rest in the grooves 19 of the slide plate 5.

The first and the second plates 3 and 4 are assembled by fitting said catches 11 into the indented portions 10, and welded together in assembled state.

Figure 1:
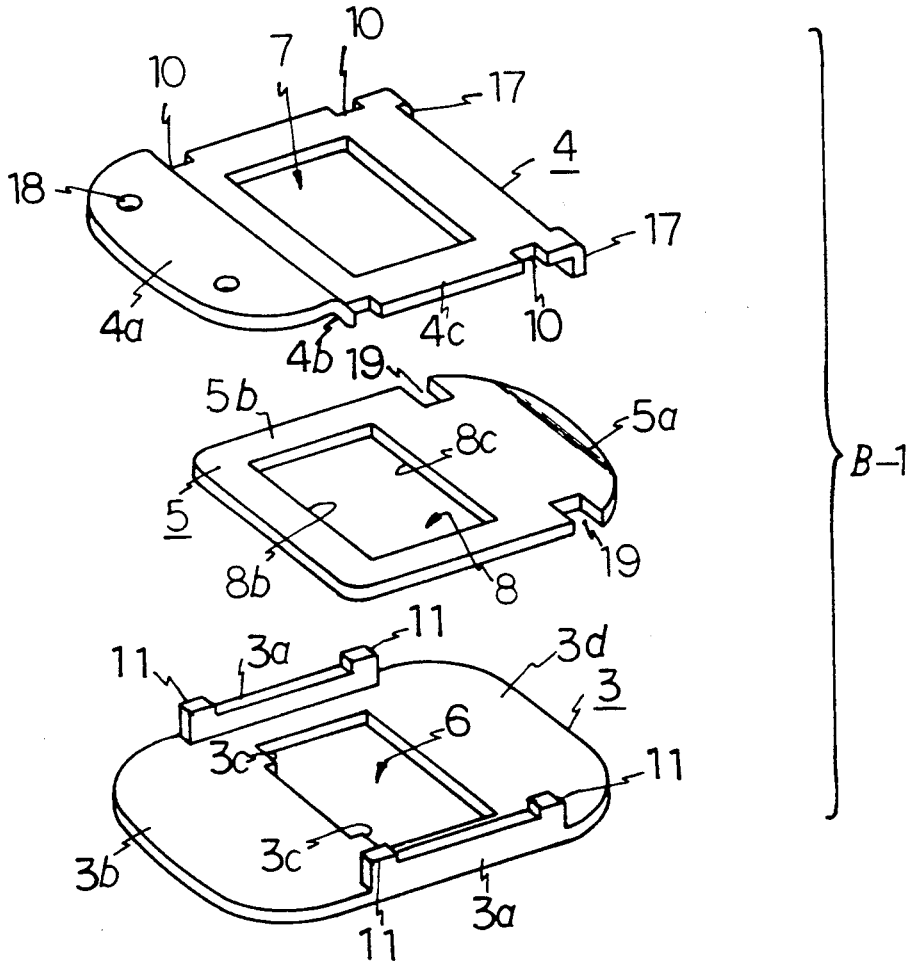
FIG. 1 is an exploded perspective view to show the component parts of a female member B-1 according to the first embodiment of the present invention.
Figure 2:
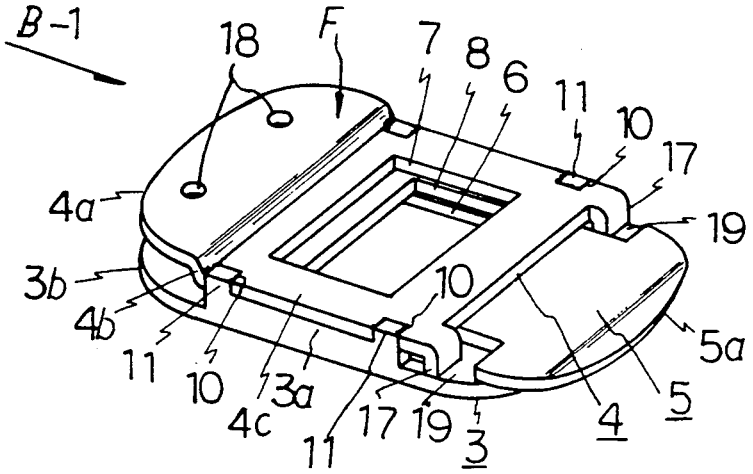
FIG. 2 is a perspective view of the female member B-1.
Figure 3:
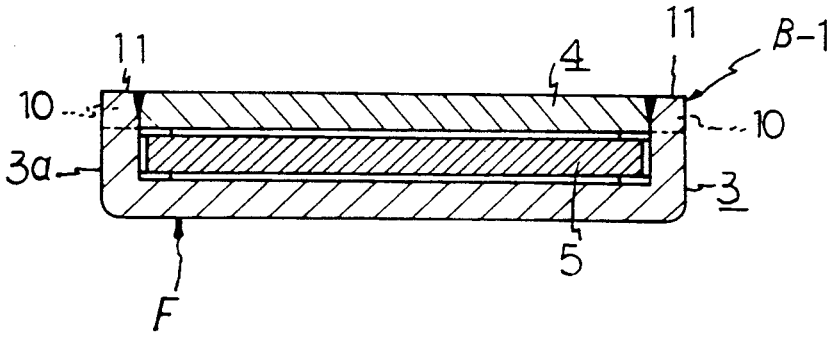
FIG. 3 is a sectional view to show welding of catches 11 with dents 10.
Figure 4:
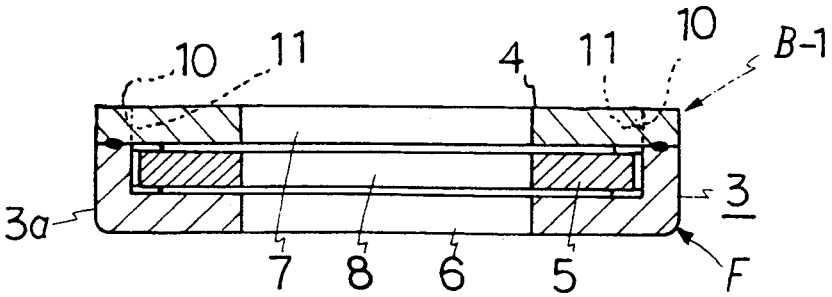
FIG. 4 is a sectional view to show welding on sides.

Said indented portions 10 and the catches 11 fitted therein may be fixed together by welding as shown in FIG. 3. Alternatively, the first and second plates 3 and 4 may be stably assembled by engaging the catches into the indented portions 10, and then finally fixed together, as shown in FIG. 4, by welding the upper ends of the sides 3*a* of the first plate 3 with the face of the second plate 4 contacting thereto.

Still alternatively, the first and the second plates 3 and 4 may be welded on the portions where the first and the second plates contact other than the above. Although the two plates are welded on the surfaces thereof which contact each other as shown in black in the figures, they may be welded on the sides of the contacting surfaces or the sides of the members to be welded. Further, they may not be entirely welded along the contacting portions but may be partly welded so long as they do not become separated.

The welding method used herein for fixing includes well-known methods such as melt welding, pressure welding, diffusion welding and braze welding, and typically resistance welding such as spot welding, arc welding, and brazing.

With the female frame F of the above construction, the slide plate 5 will not slip out because the engagement strips 17 rest in the grooves 19 of the slide plate 5 with the manipulation lip member 5*a* protruding slightly outside from the frame F, as well as because the slide plate 5 is slidably inserted in between the first and the second plates 3 and 4.

The opening 6 in the first plate 3, the opening 7 of the second plate 4 and the opening 8 of the slide plate 5 inserted inside the female frame F all communicate with one another so as to allow the projection E of the male member A-1 to be freely inserted/removed. The openings 6 and 7 respectively have a size that will allow the projection E to be fitted. The openings are also large enough to receive the projection E without play.

The slide plate 5 slidably inserted in the female frame F has an opening 8*a* on the side where the manipulation lip member 5*a* is provided, the opening 8*a* being wider than the openings 6 and 7 in the direction of the lip member 5*a*. Further, the periphery 8*b* of the opening 8 on the opposite side of the lip member 5*a* protrudes outward from the openings 6 and 7 (see FIG. 5).

The female member B-1 of the above construction is attached to the base material D by means of a screw 20 as base material D is inserted in between the portion 3*b* of the first plate 3 and the portion 4*a* of the second plate member 4 to reach the bent portion 4*b*.

Figure 5:
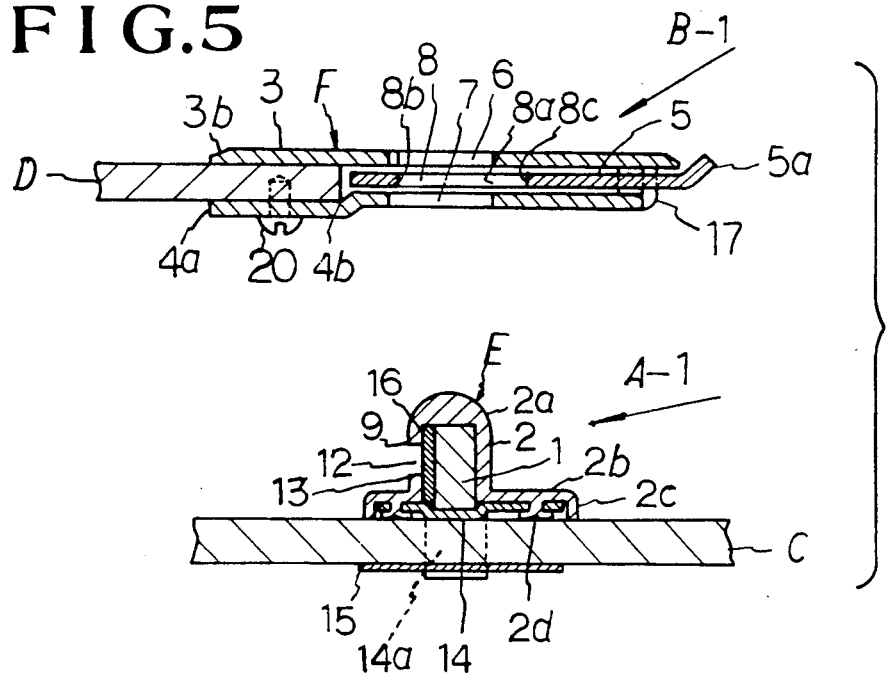
FIGS. 5 and 6 show the tentative engagement of the male and female members in section, FIG. 5 showing the state before engagement and FIG. 6 at the time of engagement.
Figure 6:
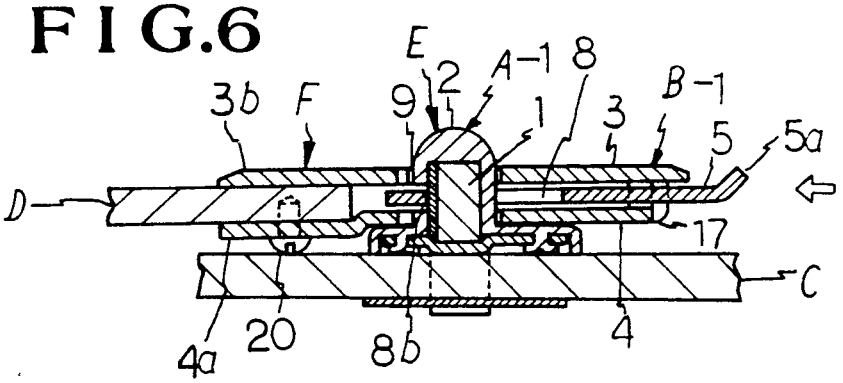

The male member A-1 and the female member B-1 are assembled as shown in FIGS. 5 and 6.

The male member A-1 is released from the female member B-1 as the slide plate 5 is pressed inwardly, and attracts the female member B-1 in a manner to make the lip member 5*a* of the slide plate 5 project outward.

As a result, the male member A-1 is engaged with the female member B-1 with the dent 12 for engagement provided in the the projection E facing opposite the direction the lip member 5*a* of the female member B-1 is protruding.

By attaching the male member A-1 to the female member B-1 as shown in FIG. 6, one of the peripheral edges 8*b* of the opening 8 in the slide plate 5 is attracted by the permanent magnet 1 of the projection E with a force greater than that acting on the other peripheral edge 8*c* across the hole 8*a*. By providing the dent 12 for engagement in the projection E on the side of this peripheral edge 8*b*, the peripheral edge 8*b* of the slide plate 5 will be able to be attracted to the face of the projection E inside the dent 12.

As a result, if the male member A-1 is pulled out from the female member B-1, the projection E will move in the pulling direction with the slide plate 5 attracted thereto. As the jaw 9 of the dent 12 abuts against the upper face of the peripheral edge 8*b*, the male member A-1 will be prevented from slipping out.

When the male and the female members are in such an engagement, they can be disengaged from each other by pulling them apart while moving the slide plate 5 attracted to the projection E inside the dent 12 in the direction of arrow in FIG. 6, or in the direction of press fitting the slide plate 5.

Referring now to FIG. 9, the fastener means according to the second embodiment will be explained.

The component parts of the male and the female members A-2 and B-2 respectively according to the second embodiment are substantially identical with those of the first embodiment. The parts having the same functions are denoted by the same reference numbers, and explanation is omitted.

The male member A-2 according to this embodiment is provided with an engagement strip 9*a* that extends laterally at the head of the projection E. The engagement strip 9*a* functions in the same manner as the engagement dent 12 in the projection E of the male member A-1 according to the first embodiment.

In other words, the projection E in the male member A-2 has a bulging portion 9*a* at the head of the projection E as shown in FIG. 9, and the edge of the slide plate 5 will be attracted to the face of the projection E located below this engagement strip 9*a*.

It should be noted that the engagement strip 9*a* is not limited to the one shown in the figure; a flange may be provided to extend from the projection E. The engagement strip 9*a* may be formed as a pin or the like extending from the projection E.

The peripheral edges 8*e*, 8*f* of the opening 8 in the slide plate 5, the opening 6 of the first plate 3 and the opening 7 of the second plate 4 of the female frame F are in an inverted positional relation as against that in the first embodiment.

More particularly, when the slide plate 5 is pulled outward, the peripheral edge 8*f* of the opening 8 on the side of the manipulation lip member 5*a* becomes aligned with or projects slightly toward the peripheral edges of the openings 6 and 7. The peripheral edge 8*e* on the opposite side is separated from the openings 6 and 7 by means of the portion 8*d* which is laterally wider.

By connecting the male member A-2 and the female member B-2 in a reverse direction to that employed in the first embodiment, i.e. by arranging the engagement strips 9*a* of the projection E to face the manipulation lip member 5*a*, engagement/disengagement of the male and the female members is manipulated in the reverse manner. The slide plate 5 of the female member B-2 is attracted inward by the projection E when the male member A-2 is inserted in the female member B-2, with the peripheral edge 8*f* attracted to the projection E. When the projection E is pulled in the direction of disengagement, the upper face of the peripheral edge 8*f* abuts against the engagement strip 9*a* to prevent the projection E from slipping out.

By pulling the slide plate 5 in the direction of disengagement (in the direction of an arrow in FIG. 9) while the male and the female members are in engagement, the male and the female members can be pulled apart and become disengaged.

Referring to FIGS. 10 and 11, the fastener means according to the third embodiment will be explained.

The female member B-3 according to the third embodiment is substantially identical in construction with the first embodiment except that indented portions 10′ are provided on the sides 3*a* of the first plate 3. Catches 11′ which fit in the indented portions 10′ project from the side edge of the second plate 4. Component parts having identical functions are denoted with the same reference numbers and description thereof is omitted.

According to the third embodiment, the slide plate 5 and the second plate 4 are attached to the first plate 3 of the female member B-3 in the same manner as in the first embodiment. Then, by fitting the catches 11′ in the indented portions 10′ of the first plate 3, the first plate 3 and the second plate 4 are firmly engaged by welding.

The fixing of the first and second plates 3 and 4 by welding may be performed according to the same technique and mode of operation as those used for the first and the second plates of the female member B-1 of the first embodiment.

The catches 11′ fitted in the indented portions 10′ may be welded to the indented portions, or the side faces of the sides 3*a* may be welded to the sides of the second plate 4 which contact the sides 3*a*. Welding may be performed on parts other than mentioned above.

The female member B-3 of the third embodiment is used in the same manner as in the first embodiment and a male member which is identical in construction with the male member A-1 is used. Illustration thereof is therefore omitted.

Referring to FIGS. 12 through 15, the fastener means according to the fourth embodiment will be explained.

The fastener means according to the fourth embodiment is essentially the same as that of the first embodiment except that the appearance of the male member A-4 is modified, and the ferromagnetic plate 16 is further provided with a ferromagnetic plate 16'. The female member B-4 is also substantially identical with that of the first embodiment. Component parts having the identical functions are denoted with the same reference numbers and description is omitted except for those that are modified.

The first plate 103 forming the female frame F includes sides 3a, 3a, an opening 6 into which the male member A-4 is inserted, catches 3c at the corners of the opening 6, and holes 22 provided on the side of the portion 3b. Lobes 3e project from both edges of the portion 3d to define a dent portion 21. Catches 11 are provided on the sides 3a which fit in the indented portions 10 of the second plate 104.

The second plate 104 includes an opening 7 into which the male member A-4 is inserted. The plate 104 is so constructed that it can be attached to the first plate 103 between its sides 3a, 3a. Said indented portions 10 are provided on the sides to receive said catches 11. Stopper strips 23, 24 which are bent downward to reach the first plate 103 are also provided.

The stopper strips 23, 24 are provided on the sliding side of the slide plate 105, which in turn is to be inserted between the first and the second plates 103 and 104 of the female frame F. The stopper strips 23, 24, together with the sides 3a, 3a of the first plate 103 act to prevent the slide plate 105 from slipping out.

The stopper strips 23, 23 are provided at the corners of the plate 105 at an interval that will allow the manipulation lip member 5a to be pushed in/pulled out without play.

The slide plate 105 includes a larger opening 8 which communicates with said openings 6 and 7, and is so shaped that it can be slidably inserted in the female frame F. There is provided the manipulation lip member 5a projecting in the direction of its slide movement and having a width smaller than the slide plate 105.

The slide plate 105 of the above construction is inserted between the first and the second plates 103 and 104 in a manner that will allow the lip member 105 to stick out from between said stopper strips 23, 23. Said catches 11 are assembled in the same manner as in the first embodiment to firmly weld the first and the second plates 103 and 104 in engagement to thereby constitute the female member B-4.

The stopper strips 23 of the second plate 104 abut against the lobes 3e of the first plate 103, so that the edge 21a of the dented portion 21 in the first plate 103 and the edge 4c of the second plate 104 are arranged on substantially the same plane.

When the lip member 5a of the slide plate 105 inserted in the female frame F is caused to move out of the frame F, a shoulder 27 of the lip member 5a will abut against the stopper strips 23. The lip member 5a is so shaped that it will stick out as little as possible from the line connecting the tip ends of the lobes 3e, 3e when said stopper strips 23 rest against the shoulder 27.

The positional relation of the opening 8 of the slide plate 105 and openings 6 and 7 of the first and the second plates 103, 104 of the female frame F respectively is the same as that in the first embodiment. The opening 8a is wider in the direction toward the lip member 5a. The peripheral edge 8c is on the side of the opening 8a separated from the peripheral edges of the openings 6, 7 while the peripheral edge 8b is provided near said edges of the openings 6 and 7.

The plate portion 3b of the first plate 103 is attached to the base material D, to which is attached the fixing plate 25 having holes 25a. Pins with a head each are inserted through the holes 25a to connect the female member B-4 to the base material by compressing the other end of the pin.

The fastener means according to this embodiment is engaged/detached and manipulated in the same manner as in the first embodiment. Description is therefore omitted.

According to the fourth embodiment, the lip member 5a of the slide plate 105 is merely exposed in the dented portion 21 of the plate 103 and does not substantially stick out from the line connecting the tips of the lobes 3e, 3e. This arrangement facilitates pressing of the slide plate inside the dented portion 21 and prevents unexpected slipping out of the lip member 5a.

In the embodiments described above, the catches 11, 11' are provided on either the first or the second plate 103 or 104, and the dented portions 10, 10' are provided on either the first or the second plate 103 or 104. Catches 11, 11' and the dented portions 10, 10' may be provided on the sides 3a of the first plate 103 and corresponding catches and dented portions 10, 10' and 11, 11' on the second plate 4, 104 as well.

It should be noted that the present invention is in no way limited by these embodiments. It is therefore possible to provide a tab on the slide plate inserted in the female frame so that the tab will project outside the female frame.

It is also possible to provide an opening in the female frame so as to manipulate the slide plate through this opening.

This invention is advantageous in that welding can be easily and precisely performed without making errors in positioning as the catches 11, 11' are fitted into the indented portions 10, 10' to assemble the first and the second plates 3, 103 and 4, 104 before welding, in addition to other advantageous features.

What We claim Is:

1. A fastener means comprising a male member which is provided with either a projection made of a permanent magnet or a projection having a permanent magnet, and a female member which includes a female frame comprising a first and a second plate members, and a slide plate which is made of a ferromagnetic material, slidably inserted between said first and the second plate members and manipulated from the outside of the female frame, said first and the second plate members and the slide plate having communicating openings through which said projection of the male member is inserted, said projection to be inserted in the female member being provided with either a dent or a strip for engagement on the side where said slide plate is attracted by the permanent magnet of the projection, and the peripheral edge of the opening of the slide plate being attracted to one face of the projection within said dent or to a face of said projection located below said engagement strip, which is characterized in that said first plate of the female frame includes two opposing sides that are bent inward along the edges, and dented portions and/or catches on the upper ends of said sides, and said second plate has on its side edges catches which fit into said indented portions or indented portions which receive said catches, and said first plate and the second plate which are assembled by inserting said catches into said indented portions are firmly engaged by welding.

2. The fastener means as claimed in claim 1 wherein said first and/or second plate member is made of a ferromagnetic material.

3. The fastener means as claimed in claim 1 wherein said first and the second plate members are made of a non-magnetic material.

4. The fastener means as claimed in claim 1 wherein said catches are provided on the upper edges of the sides of the first plate member and indented portions for receiving said catches are provided on the side edges of the second plate member.

5. The fastener means as claimed in claim 1 wherein said catches are provided on the side edges of the second plate member and indented portions for receiving said catches are provided on the upper edges of the sides of the first plate member.

6. The fastener means as claimed in claim 1 wherein said catches are fitted in said indented portions.

7. The fastener means as claimed in claim 1 wherein a portion of said slide plate projects outward from said female frame.

8. The fastener means as claimed in claim 1 wherein a portion of said female frame is removed, and a portion of said slide plate is exposed through an opening made by this removed portion.

9. The fastener means as claimed in claim 1 wherein said slide plate is contained in said female frame, and a portion of said slide plate projects outward from the female frame when the slide plate is attracted by said female member.

10. The fastener means as claimed in claim 1 wherein said engagement dent provided in the projection of the male member is a groove-like stepped portion formed in said projection.

11. The fastener means as claimed in claim 1 wherein said engagement strip on the projection of the male member is a portion protruding from the projection on its top in the form of a step.

12. The fastener means as claimed in claim 1 wherein said welding is performed between the indented portions and the catches fitted inside the indented portions.

13. The fastener means as claimed in claim 1 wherein said welding is performed between the upper edges of the sides of the first plate and the second plate on the portions thereof which contact the upper edges of the first plate.

14. The fastener means as claimed in claim 1 wherein said welding is performed between side faces of the sides of the first plate and the side faces of the second plate which contact said side faces of the first plate.

* * * * *